United States Patent [19]

Guenther

[11] Patent Number: 4,745,951

[45] Date of Patent: May 24, 1988

[54] COIL SPRING HOOKING METHOD AND APPARATUS

[76] Inventor: Arthur W. E. Guenther, 1153 Pioneer Rd., Burlington, Ontario, Canada, L7M 1K5

[21] Appl. No.: 399,840

[22] Filed: Jul. 19, 1982

[51] Int. Cl.[4] ..... B21F 35/02

[52] U.S. Cl. ..... 140/103

[58] Field of Search ..... 140/103; 72/137, 130, 72/306, 311; 269/902, 269; 29/33 J, 33.5, 785, 792

[56] References Cited

U.S. PATENT DOCUMENTS

| | | | |
|---|---|---|---|
| 895,724 | 8/1908 | Church | 29/33.5 |
| 1,498,638 | 6/1924 | Periolat | 269/269 |
| 2,005,375 | 6/1935 | Jones et al. | 29/785 |
| 2,650,634 | 9/1953 | Young et al. | 72/311 |
| 2,809,675 | 10/1957 | Silko | 140/103 |
| 3,195,583 | 7/1965 | Jones | 140/102 |
| 3,253,622 | 5/1966 | Hammersmith | 140/103 |
| 3,351,101 | 11/1967 | Halvorsen et al. | 140/103 |
| 3,405,772 | 10/1968 | Guenther | 175/77 |
| 3,672,410 | 6/1972 | Scheckel | 140/103 |
| 3,805,576 | 4/1974 | Brauer | 72/306 |
| 3,874,425 | 4/1975 | Guenther | 140/103 |

FOREIGN PATENT DOCUMENTS

| | | |
|---|---|---|
| 39464 | 11/1971 | Japan . |
| 569269 | 11/1945 | United Kingdom . |
| 583624 | 1/1947 | United Kingdom . |
| 821798 | 10/1959 | United Kingdom . |
| 970291 | 10/1964 | United Kingdom . |
| 1167949 | 10/1969 | United Kingdom . |

*Primary Examiner*—Robert L. Spruill

[57] ABSTRACT

A method and apparatus for forming at least one end of a coil spring blank into a hook, in which the blank is releasably clamped on a carriage at the first of a series of succeeding stations through which the carriage is movable. Where an end loop of the coil is to be formed into a hook that loop is bent into a position transverse to the axis of the coil of the blank at a second station and at a further succeeding station the free end of the loop is severed to a predetermined length. Where a laterally extending leg of the blank is to be formed into a hook the leg is bent into a position transverse to the axis of the coil of the blank at a second station, the leg is bent at a third station to form a hook, and at a fourth station the free end of the leg is severed to a predetermined length.

34 Claims, 15 Drawing Sheets

COIL SPRING HOOKING METHOD AND APPARATUS

FIELD OF THE INVENTION

This invention relates to a method and apparatus for forming a hook on the end of a wire, for instance in the manufacture of a tension coil spring.

BACKGROUND OF THE INVENTION

Apparatus is presently available for bending a wire to form a hook, especially for hooking the free end of a coil spring. Examples of such devices are disclosed in U.S. Pat. Nos. 3,405,742 issued Oct. 5, 1968 to Arthur W. Guenher and Egon Hildebrandt and U.S. Pat. No. 3,874,425 issued Apr. 1, 1975 to Arthur W. Guenther. In machines of this type the head performing the bending operation is positioned lateral to the axis of the wire and consequently the machine occupies a considerable amount of space. Also where the head requires a larger area of adjustment to perform bends of different radii and configuration, the distance traversed by the wire holding device is greater. Both the size of the apparatus and the movements it performs make it relatively costly in manufacture and in energy consumption.

It is an object of the present invention to provide an improved method and apparatus for hooking the free end of a coil spring , in which the area where the operation is performed, and the space occupied by the apparatus, is minimised.

It is a further object of the invention to provide an apparatus, for bending a wire to form a hook, which is less costly to manufacture and uses less energy than known devices.

SUMMARY OF THE INVENTION

Essentially the invention consists of an apparatus for forming at least one laterally extending leg of a coil spring blank into a hook, comprising: movable carriage means for advancement through a succession of stations, including releasable means to clamp the spring blank at the first of said stations; bending means at the second of said stations to bend the leg of the spring blank into a position transverse to the coils of the blank, hooking means at the third of said stations to bend the leg to form a hook; and cutting means at the fourth of said stations to sever the free end of the hook to a predetermined length. In another aspect the invention consists of an apparatus for forming at least one end of a coil spring blank into a hook, comprising: movable carriage means for advancement through a succession of stations, including releasable means to clamp the spring blank at the first of said stations; bending means at the second of said stations to bend one end loop of the spring blank into a position transverse to the coils of the blank to form a hook; and cutting means at a further succeeding one of said stations to sever the free end of the hook to a predetermined length.

The invention further consists of a method of forming at least one laterally extending leg of a coil spring blank into a hook, comprising the steps, in sequence, of: releasably clamping, at a first station, the spring blank, on movable carriage means movable through succeeding stations; moving the carriage means to advance the spring to a second station and bending the leg of the spring blank into a position transverse to the coils of the spring blank; moving the carriage means to advance the spring blank to a third station and bending the leg to form a hook; and moving the carriage means to advance the spring blank to a fourth station and severing the free end of the hook to a predetermined length. Alternately the method of the invention consists of: releasably clamping, at a first station, the spring blank on movable carriage means movable through succeeding stations; moving the carriage means to advance the spring blank to a second station and bending one end loop of the spring blank into a position transverse to the axis of the coils of the spring blank to form a hook; and moving the carriage means to advance the spring blank to a further succeeding station and severing the free end of the hook to a predetermined length.

Further aspects of the invention include the leg bending means, the loop bending means, and the hooking means per se.

BRIEF DESCRIPTION OF DRAWINGS

An example embodiment of the invention is shown in the accompanying drawings in which.

Figure 6:
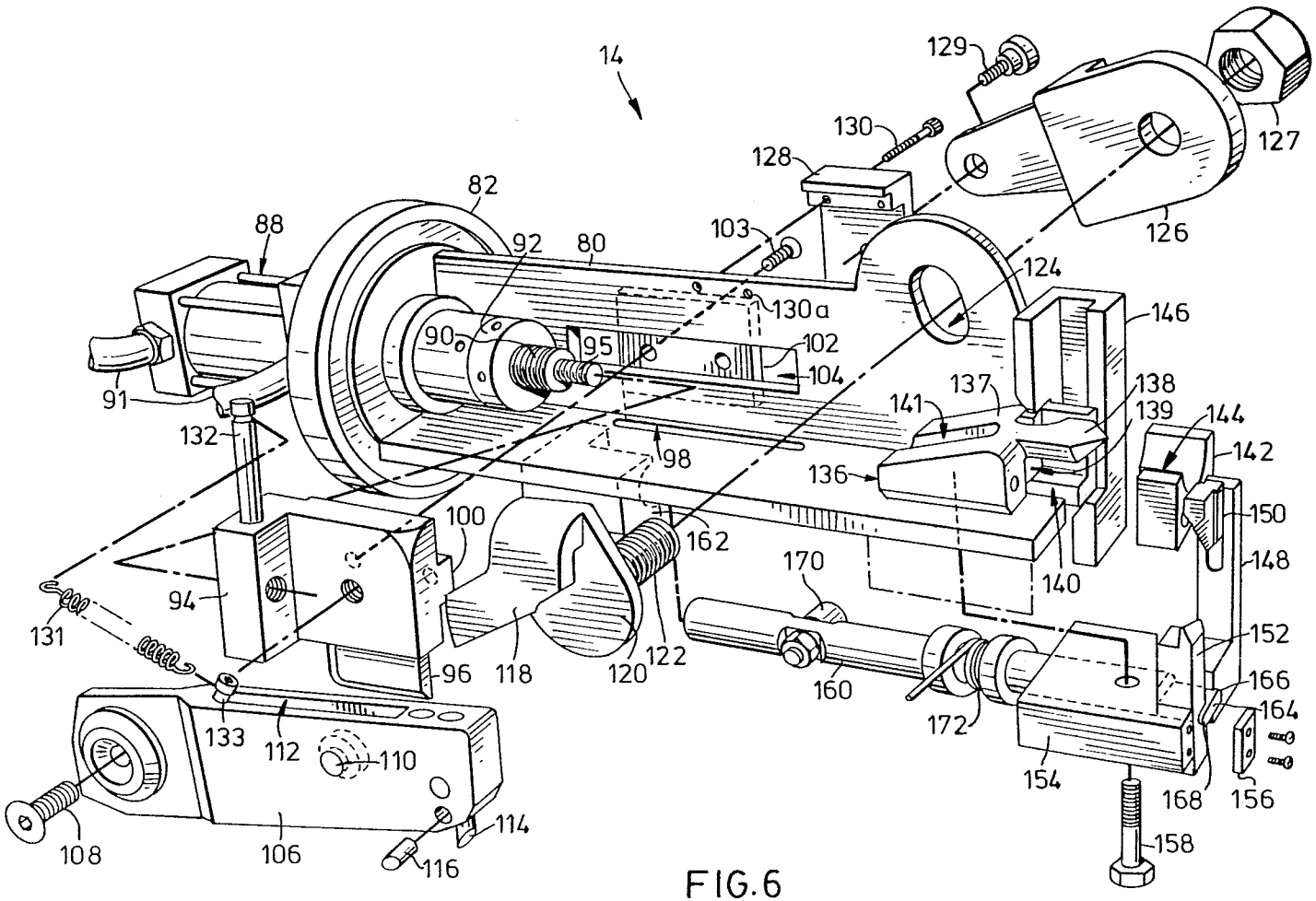
FIG. 6 is an exploded perspective view of the wire bending mechanism of the apparatus of FIG. 1.
Figure 7A:
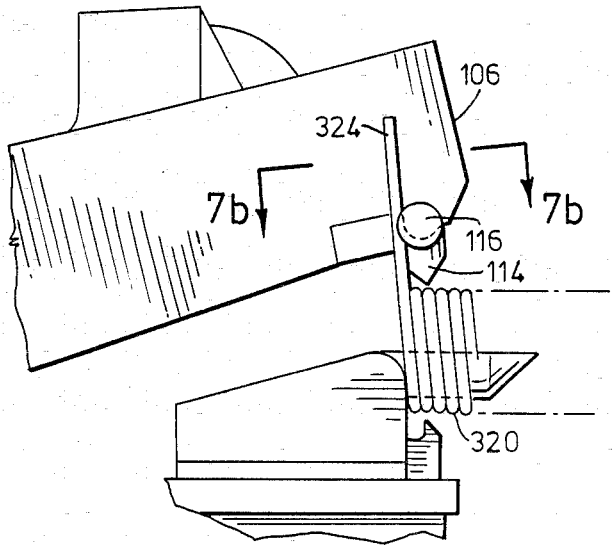
Figure 7B:
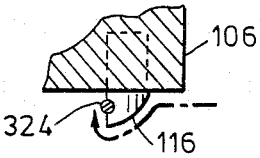
Figure 7C:
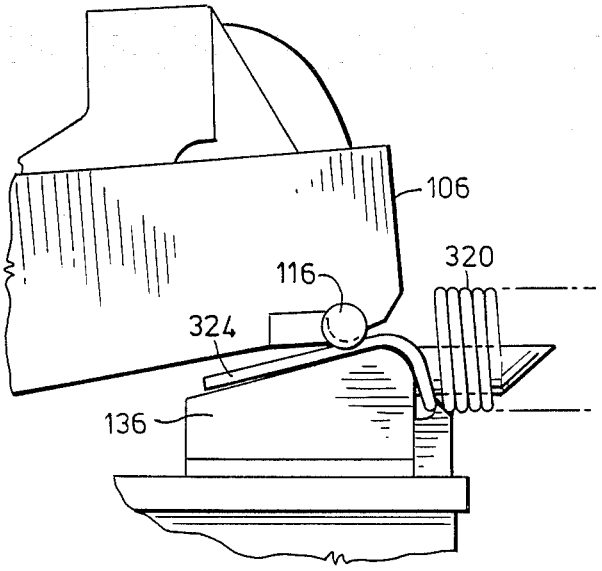
Figure 7:
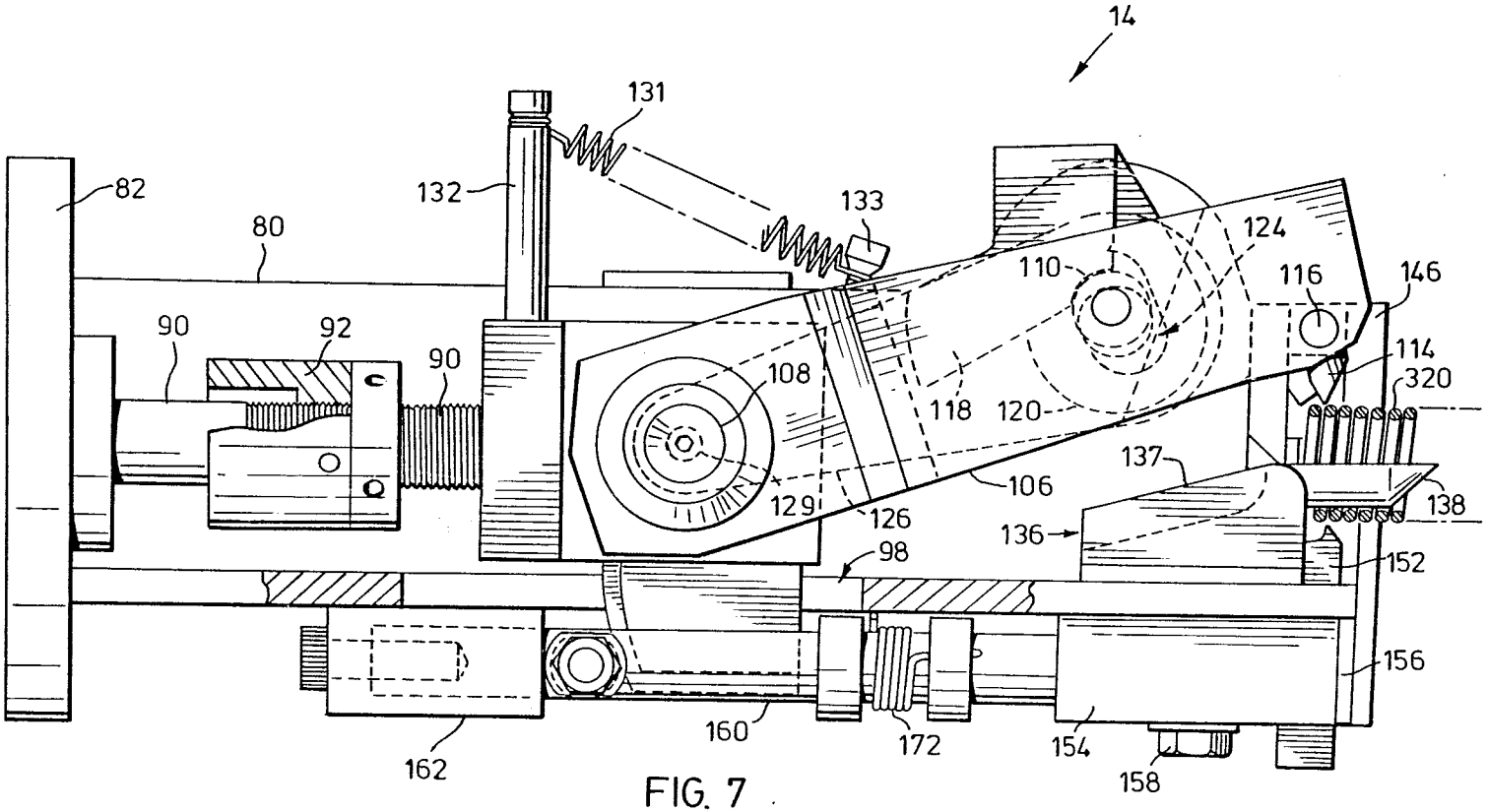

FIG. *6a* is a diagrammatic end view of the gripping device of the wire bending mechanism of FIG. 6;

FIG. 7 is a side elevational view of the coil bending mechanism of FIG. 6 before actuation of the bending lever;

FIG. *7a* is a side elevational view of a portion of the mechanism of FIG. 7 showing the bending lever contacting the end of a spring;

FIG. *7b* is a cross-sectional view taken along line *7b—7b* of FIG. *7a;*

Figure 1:
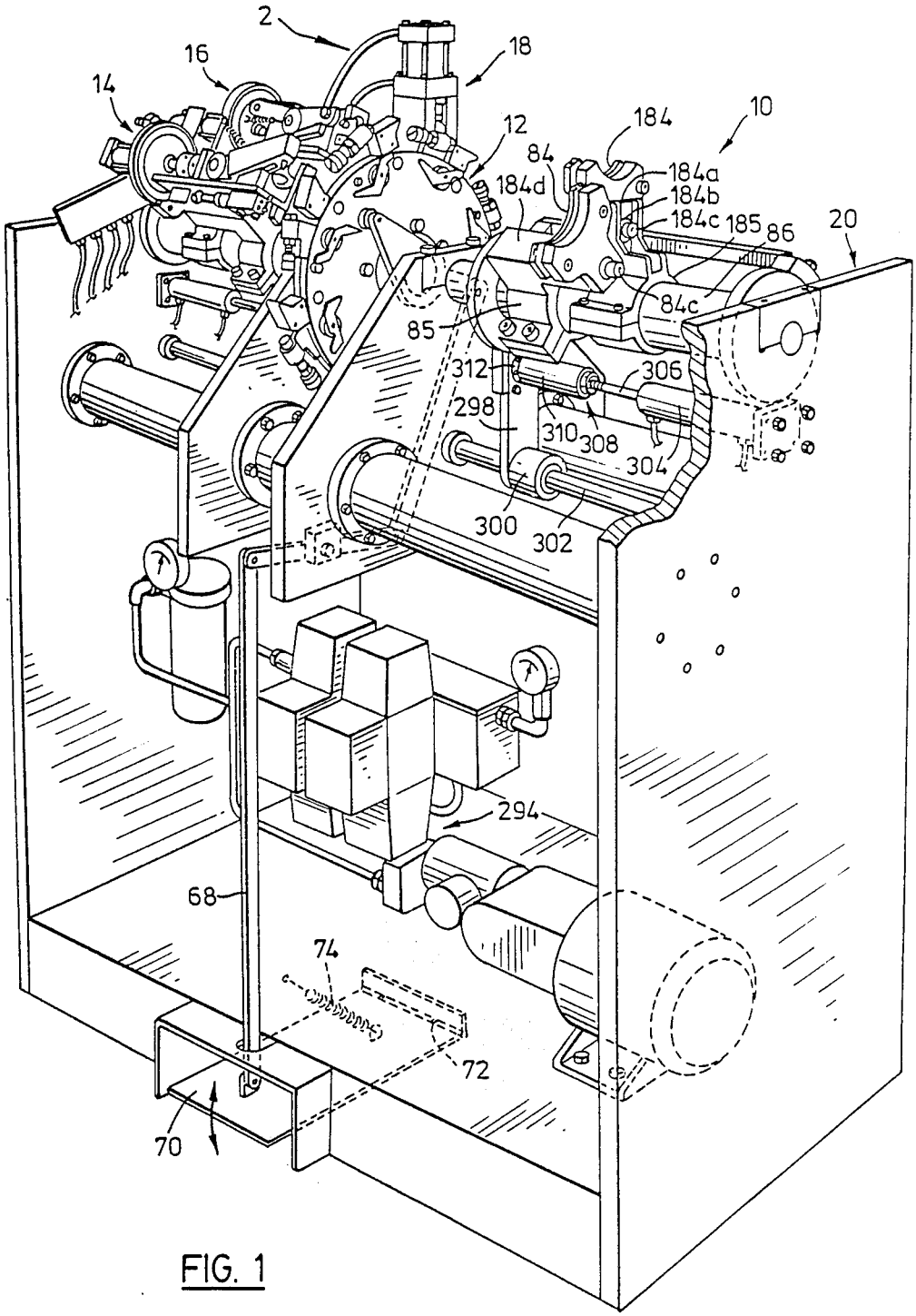
FIG. 1 is a perspective view of a wire hooking apparatus.
Figure 8:
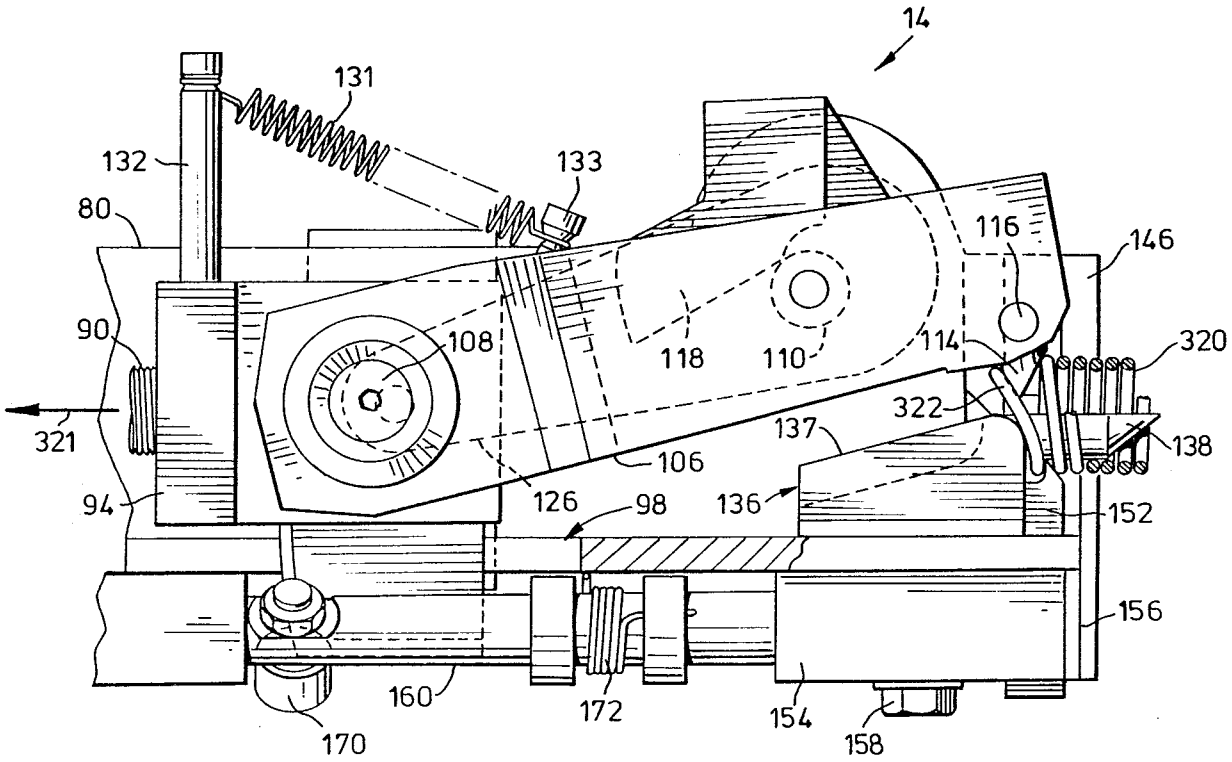
Figure 9:
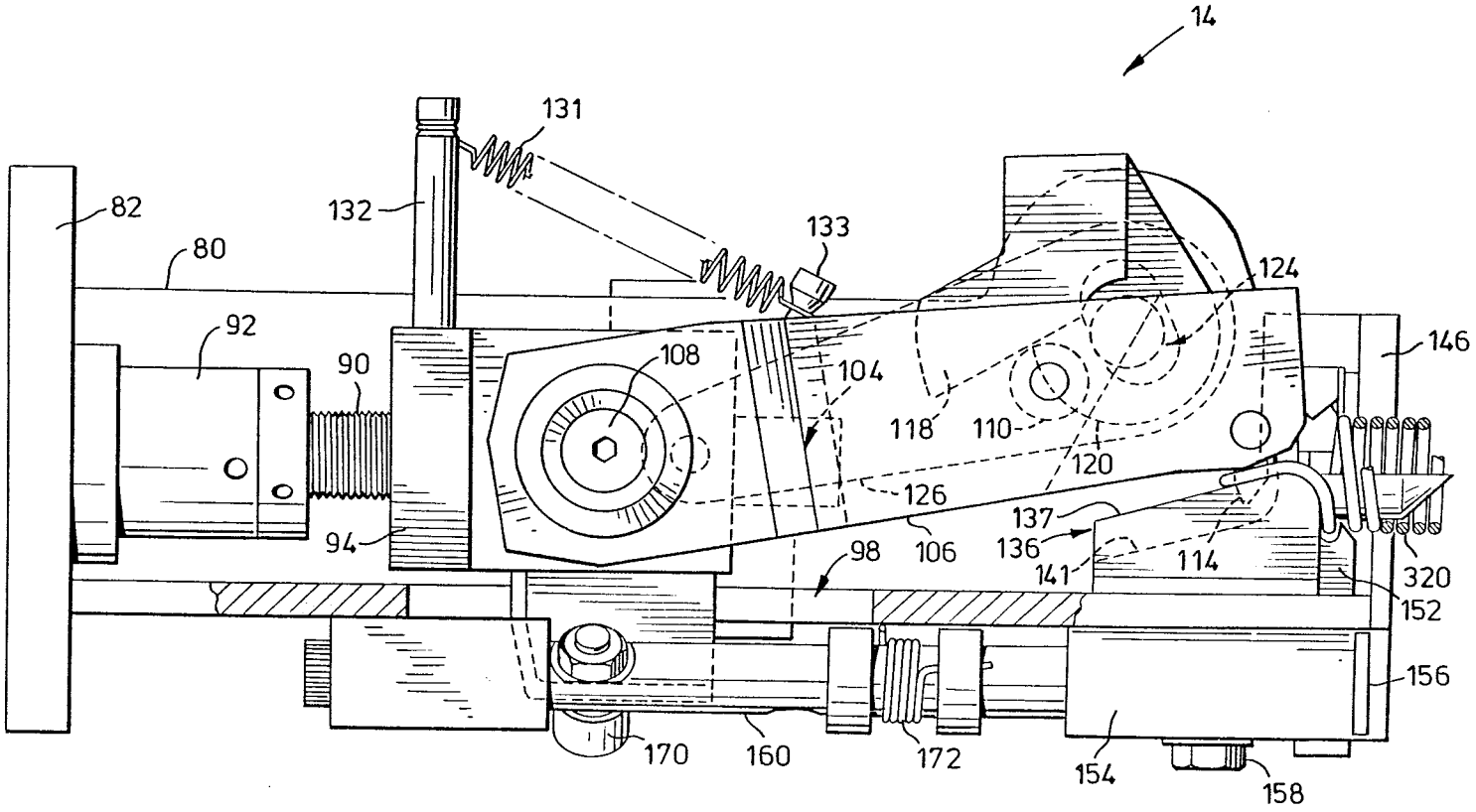
Figure 10:
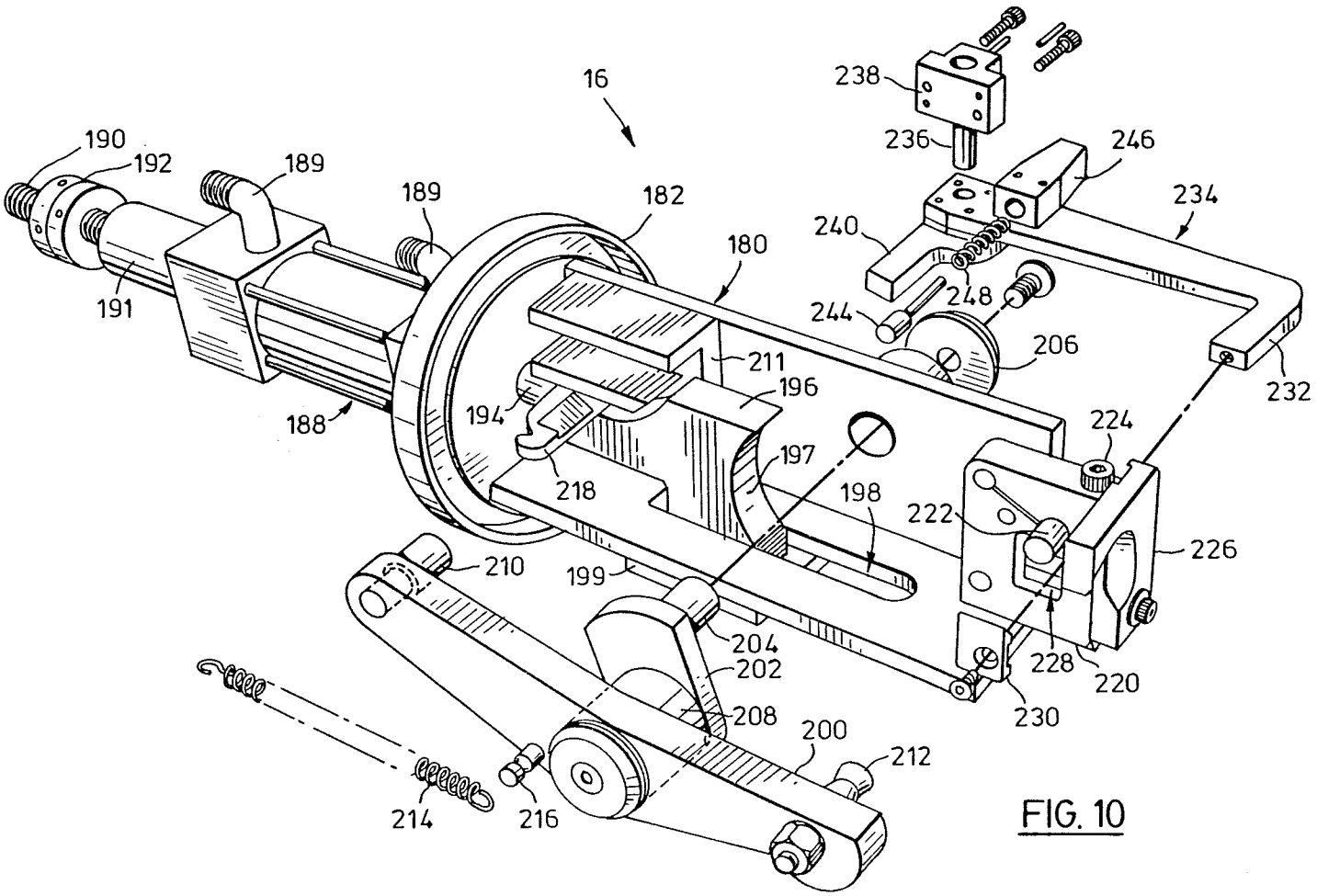
Figure 11:
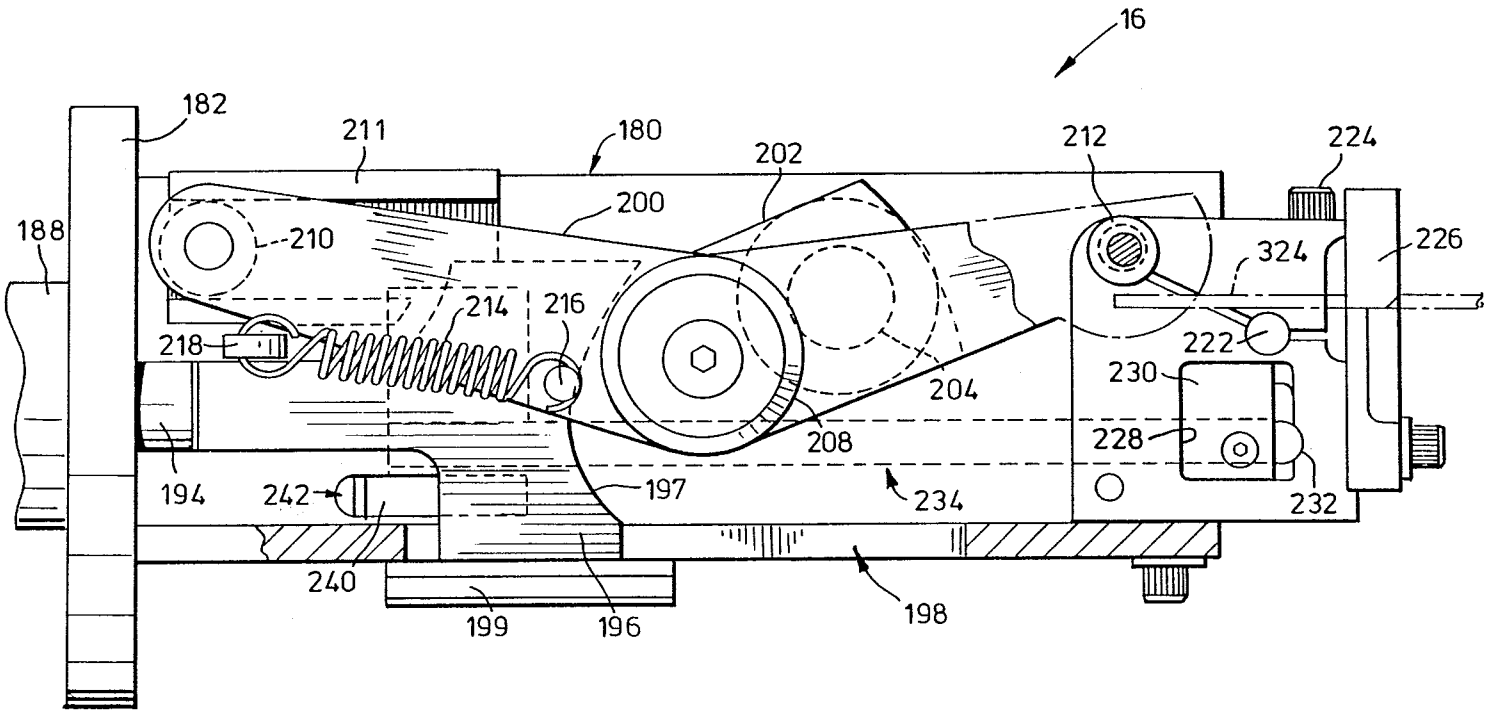
Figure 12:
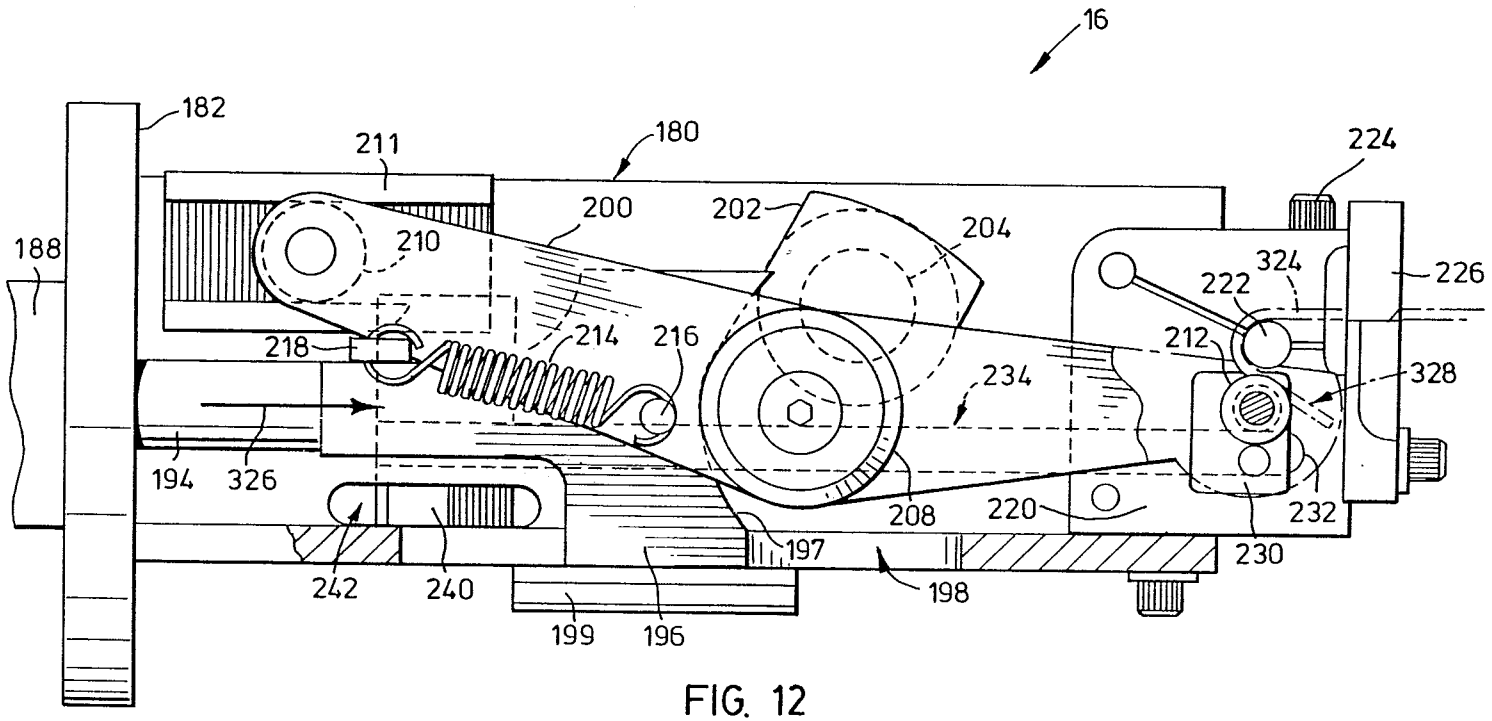
Figure 13:
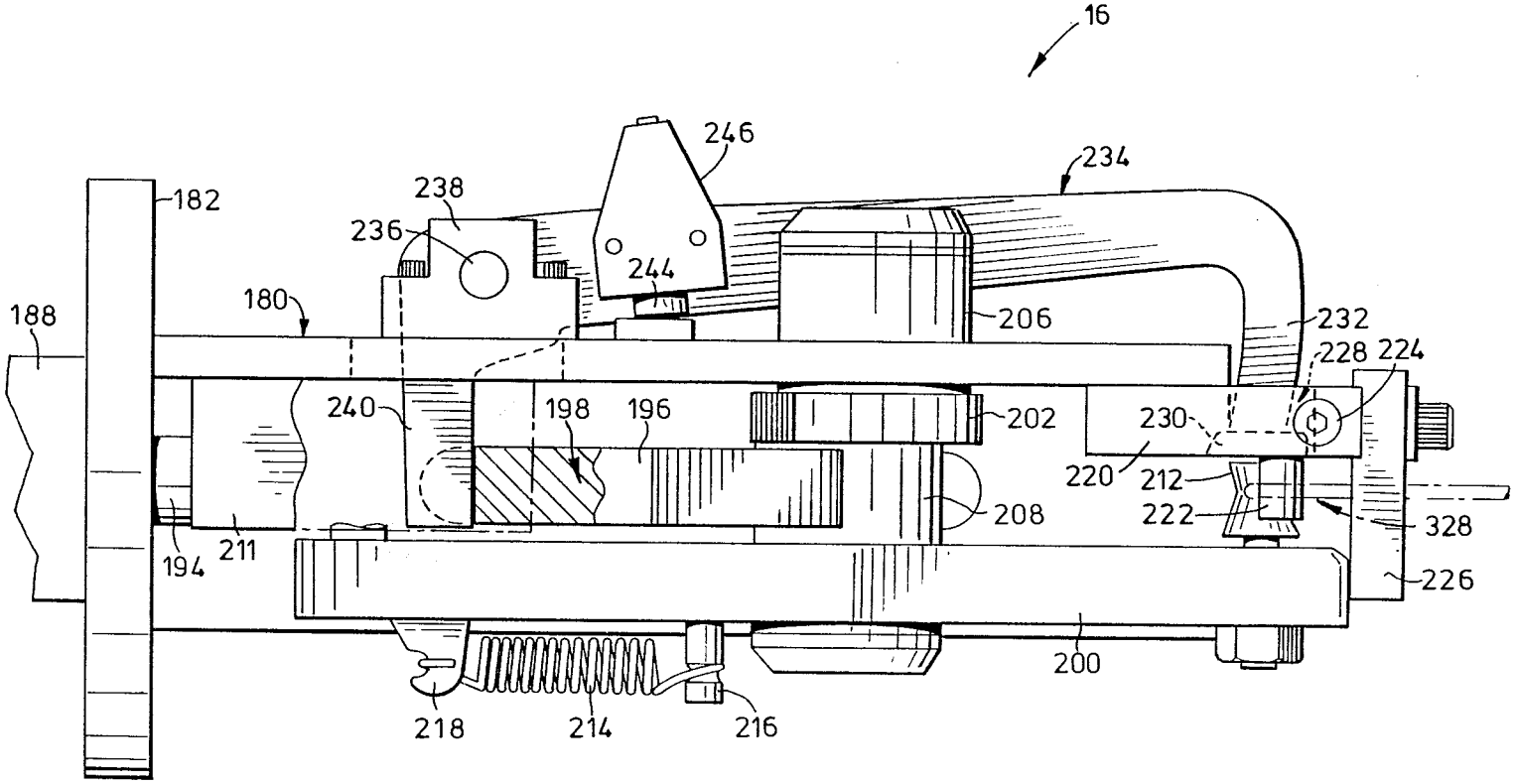
Figure 14:
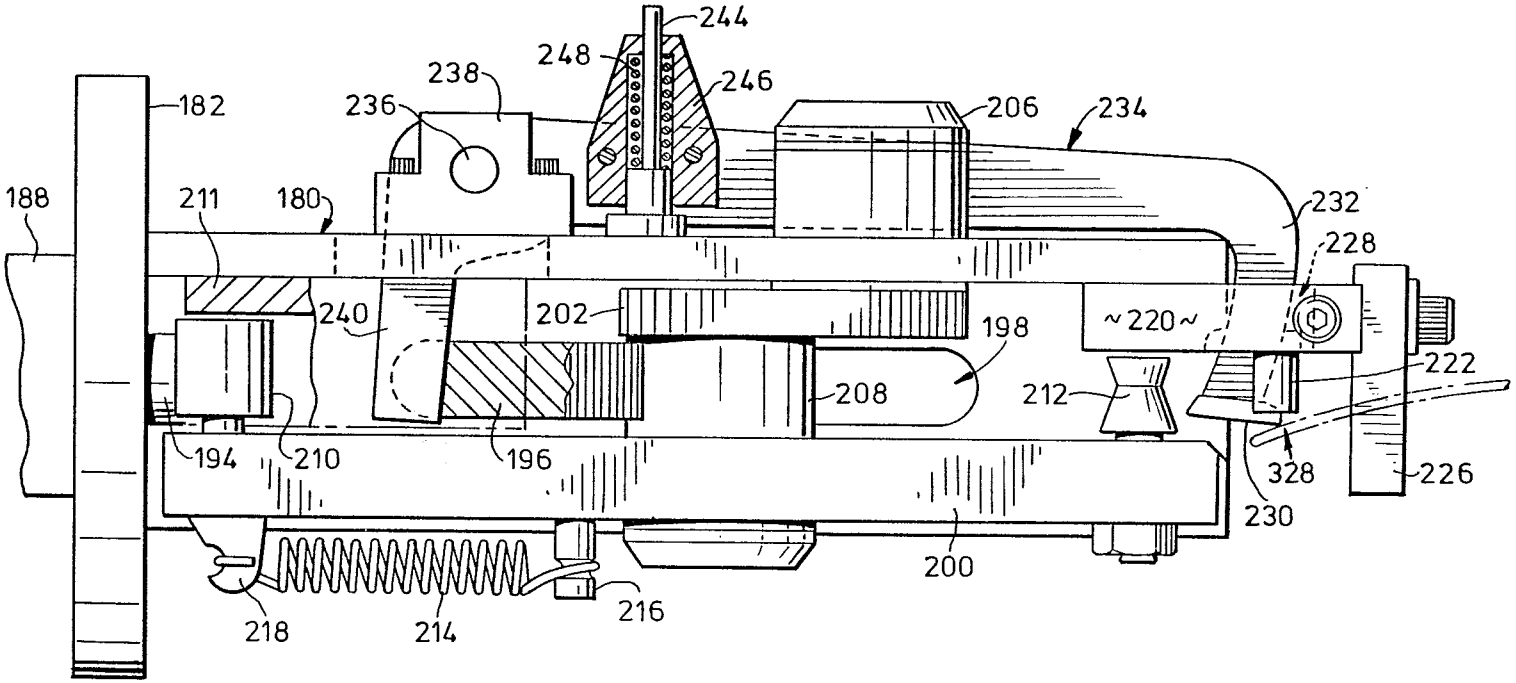
Figure 15:
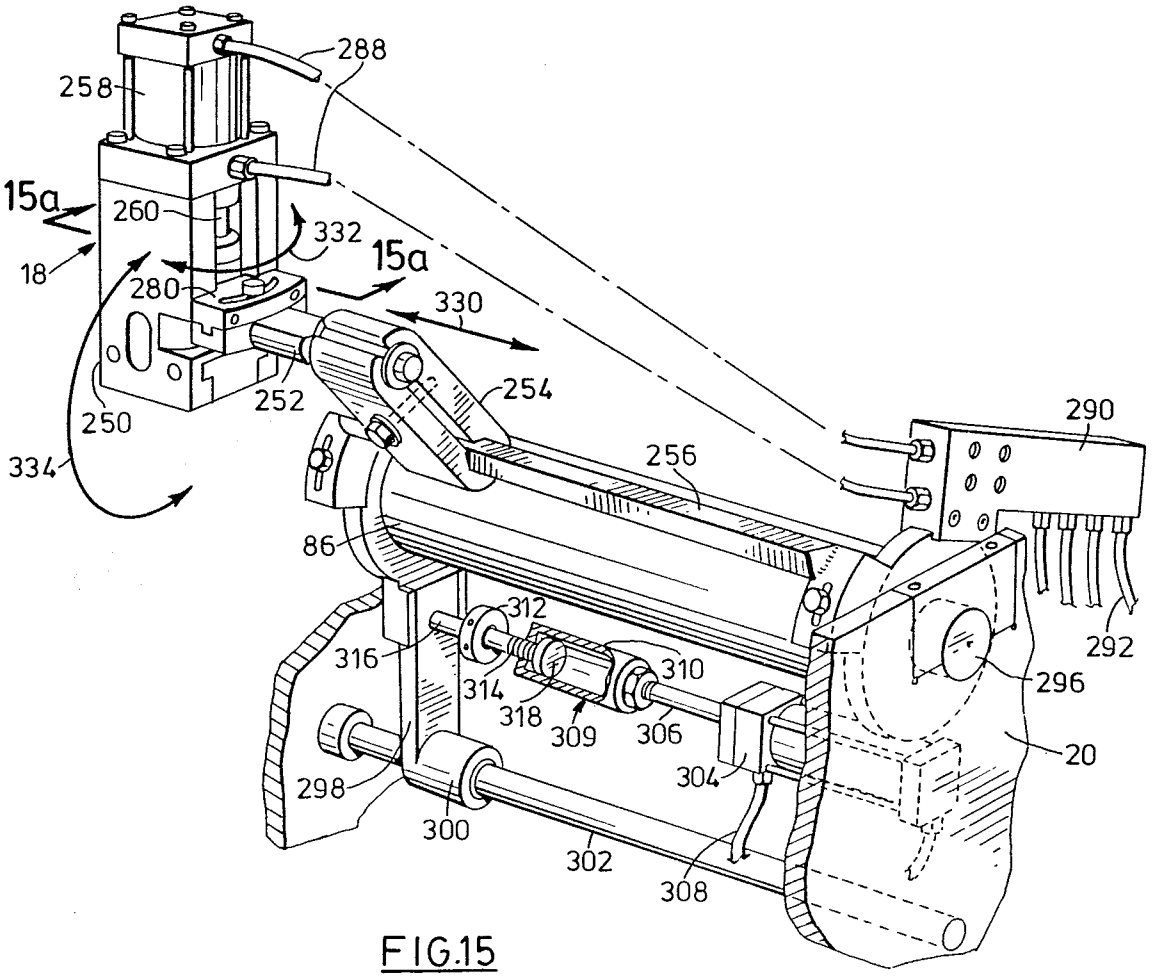
Figure 15A:
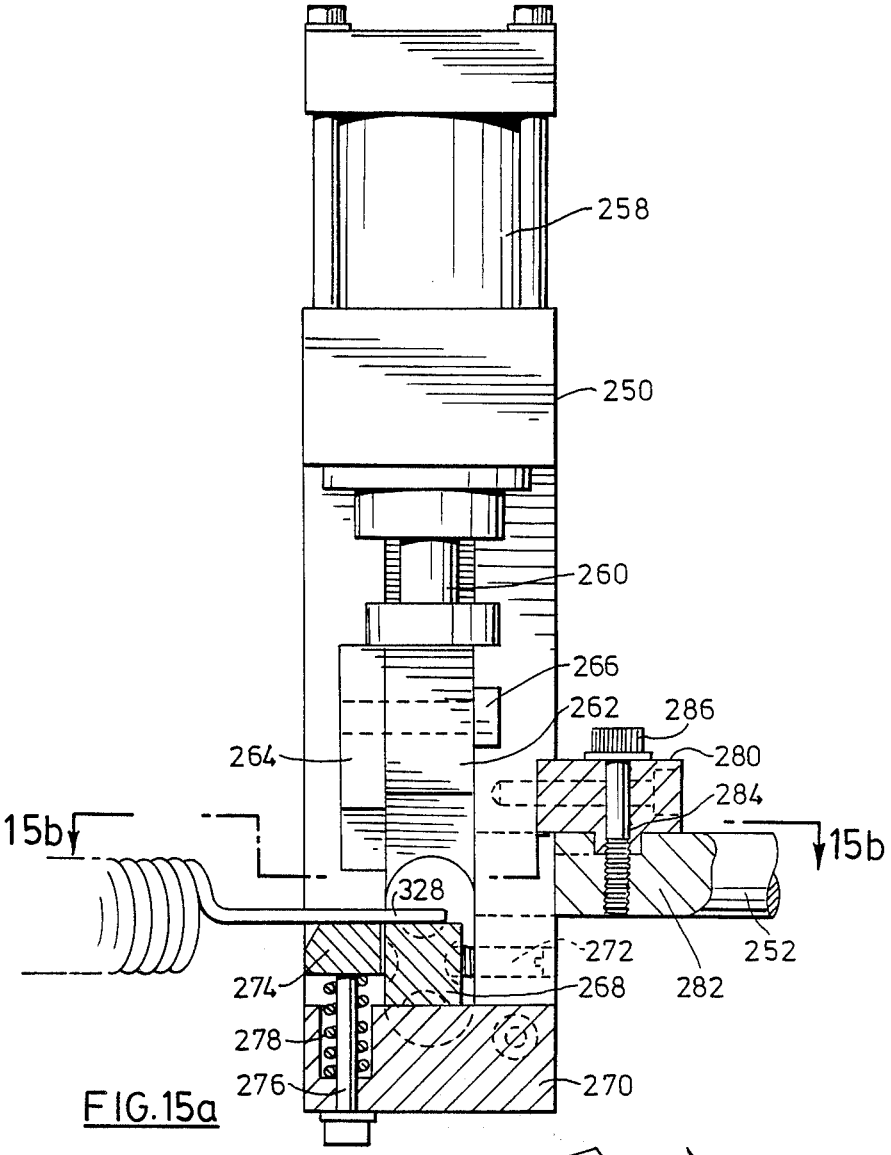
Figure 15B:
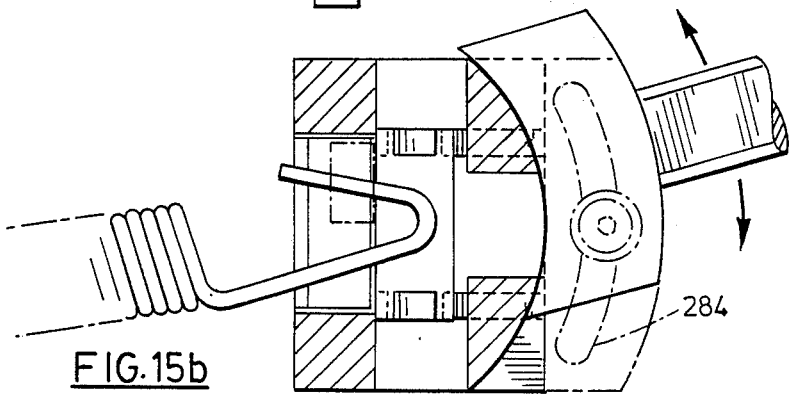

FIG. *7c* is a view similar to FIG. *7a* showing the end of the spring bent by the lever;

FIG. 8 is a view similar to FIG. 7 showing the bending lever in operation;

FIG. 9 is a view similar to FIG. 8 showing the completion of the operation of the bending lever;

FIG. 10 is an exploded perspective view of the wire hooking mechanism of the apparatus of FIG. 1;

FIG. 11 is a side elevational view of the wire hooking mechanism of FIG. 10 showing the mechanism encountering the end of a spring to be formed into a hook;

FIG. 12 is a view similar to FIG. 11 showing a hook formed in the end of the spring;

FIG. 13 is a plan view of the wire hooking mechanism of FIG. 12 with the formed hook;

FIG. 14 is a view similar to FIG. 13 showing the formed hook cleared from the mandrel of the wire hooking mechanism;

FIG. 15 is a perspective view of the cut-off mechanism of the apparatus of FIG. 1, as indicated generally by arrow 2 in FIG. 1 together with the spindle mechanism on which the cut-off mechanism is mounted;

FIG. 15*a* is a cross-sectional view of the cut-off mechanism of FIG. 15 taken along line 15*a*—15*a* of FIG. 15;

FIG. 15*b* is a cross-sectional view of the cut-off mechanism of FIG. 15 taken along line 15*b*—15*b* of FIG. 15*a*.

DESCRIPTION OF PREFERRED EMBODIMENT

The apparatus shown in the drawings consists of a wire hooking apparatus 10 comprising a spring blank carrier 12 which is centrally located between a pair of opposed bending mechanisms 14 and a pair of opposed hooking mechanisms 16 and a pair of opposed wire cutters 18, all mounted on a frame 20.

Figure 2:
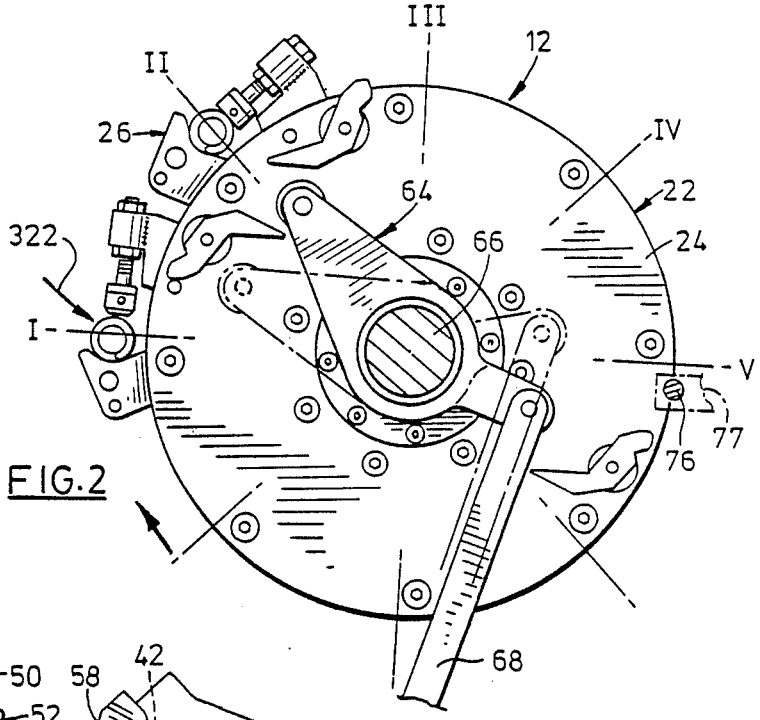
FIG. 2 is a side elevational view of the spring blank carrier of the apparatus of FIG. 1.
Figure 3:
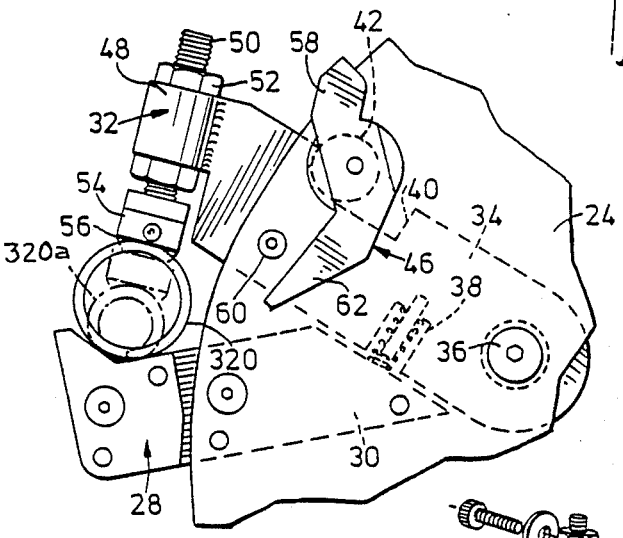
FIG. 3 is a view in detail of one of the spring clamping mechanisms of FIG. 2.
Figure 4:
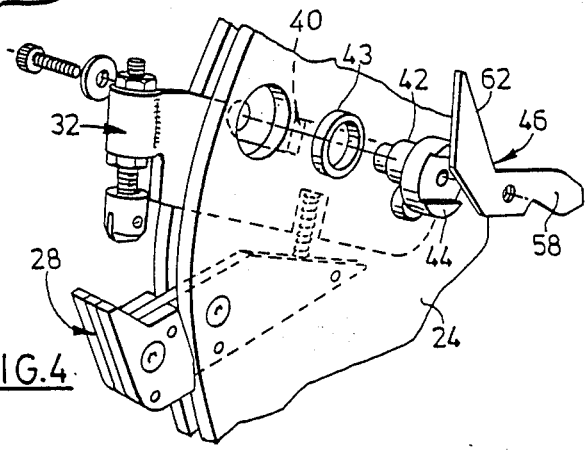
FIG. 4 is an exploded perspective view of the mechanism of FIG. 3.
Figure 5:
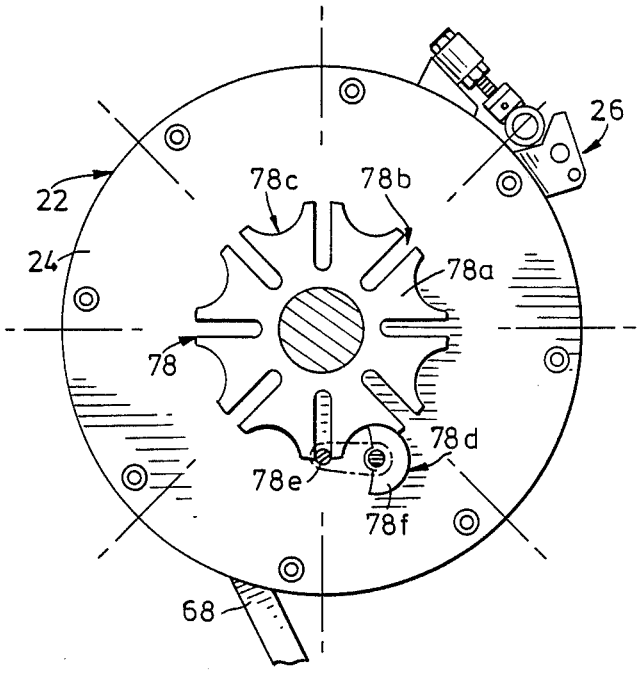
FIG. 5 is a side elevational view of the spring blank carrier of FIG. 1 showing the Geneva cam mechanism to move the carrier.

As seen in FIGS. 2 to 4, carrier 12 comprises a large diameter disc 22 having two parallel circular plates 24 spaced apart to receive the mounting flanges of a plurality of wire clamping mechanisms 26 located at spaced intervals about the periphery of the disc. Each clamping mechanism 26 comprises a fixed jaw 28 with a mounting flange 30 fixed between plates 24 and a movable jaw 32 with a mounting flange 34 which is pivotably mounted between plates 24 on a pin 36 and urged away from fixed jaw 28 by a compression spring 38. Mounting flange 34 has a notch 40 which receives an eccentric 42 having a wear ring 43 and journally mounted on a pin 44 actuated by a toggle 46 lying on the face of one of plates 24 adjacent its periphery. Movable jaw 32 comprises a boss 48 with a threaded rod 50, axially adjustable by nuts 52, carrying a blade holder 54 having a removable transverse blade 56. Toggle 46 has one shorter arm 58 engageable with a stop 60 and a longer arm 62 engageable by a lever 64 which is pivotable on an axle 66 fixed to frame 20, on which plates 24 are journally mounted. Lever 64 is connected by a series of linked rods 68 with a manually operable treadle 70 (FIG. 1) spring mounted on frame 20 by a hinge 72 with a return tension spring 74. As seen in FIG. 2, a peg 76 projecting towards disc 22 from a bracket 77 mounted on frame 20 engages shorter arm 58 of toggle 46 when that arm projects from the periphery of plates 24. Plates 24 are driven by a Geneva cam 78 shown in FIG. 5 which consists of a slotted and recessed circular cam plate **78*a* having alternating slots 78*b* and recesses 78*c* spaced around its periphery. Cam plate 78*a* is engaged by a cam follower 78*d* comprising a roller 78*e* eccentrically mounted on a segmented idler wheel 78*f*. Roller 78*e* engages slots 78*b* and idler wheel 78*f* engages recesses 78*c*** in sequence, all in known manner.

Bending mechanism 14, shown in FIGS. 6 to 9 of the drawings, comprises an angled frame 80 fixed on the front of a circular mounting disc 82 which is adjustably held by a clamping yoke 84 mounted on a collar or ring 85 slidable on a spindle 86 which is mounted on frame 20 (see FIG. 1). Yoke 84 is slidably adjustable perpendicular to the axis of spindle 86, by means of a bolt **84*c*, in a manner described later in relation to yoke 184. Drive means in the form of an hydraulic cylinder and piston assembly 88 is fixed on the rear side of mounting disc 82 with a reciprocable piston rod 90, fed by lines 91, projecting forwardly through the disc and slidable therein. A stroke adjusting locking nut 92 is threaded onto the forward end portion of piston rod 90 and a cam support block 94 is threaded onto the end 95 of the piston of reduced diameter. Block 94 carries a cam 96 which projects downwardly through a slot 98 in frame 80 while a guide shoulder 100, with a retaining back plate 102, secured to shoulder 100 by bolt 103, slides in a slot 104 in frame 80. A bending lever 106 is pivotally mounted on block 94 by a pivot bolt 108 and carries a journalled roller cam follower 110 located in a vertical slot 112 in the bending lever. A downwardly projecting tooth on wedge 114 and a laterally projecting peg 116 are located at the free end of bending lever 106**.

A cam 118 also lies in slot 112, the cam being fixed on a mounting head 120 having a threaded shaft 122 projecting through a slot 124 in frame 80 and held on a support bracket 126 by a nut 127 which clamps bracket 126 against frame 80. Bracket 126 is pivotably mounted on a spacer 128 by a pivot bolt 129, the spacer being mounted on bracket 80 by bolts 130 to separate bracket 126 from back plate 102 of cam block 94. Pivot bolts 108 and 129 are coaxial an the holes **130*a* for bolts 130 in frame 80** may be slotted for the accurate alignment of the two pivot bolts.

A tension coil spring 131, with one end connected to a post 132 on block 94 and the other end connected to a peg 133 on bending lever 106, biases cam follower 110 against cam 118.

A mandrel and anvil unit 136 is fixed to the forward end of angled frame 80 with an anvil 137 and a forwardly projecting mandrel 138 in axial alignment with piston rod 90 and located above a slot 140 in frame 80 parallel to the mandrel. Anvil 137 has a slot 141 behind mandrel 138 and a stepped recess 139 on the forward end of one side of the mandrel. A saddle 142 is positioned between mandrel 138 and slot 140, having a co-extensive slot 144. An upright channel 146 is fixed to frame 80 laterally of mandrel 138 and contains a slide member 148 with an upper tooth or wedge 150 adjustably secured to the slide member and located above mandrel 138. A lower tooth or wedge 152 projects upwardly through slots 140 and 144, that tooth being retained slidably in a mount 154 by a plate 156 and the mount being fixed to anvil 137 by a bolt 158 through slot 140. A rotatable cam shaft 160 is also mounted on the underside of frame 80 with one end of the shaft retained by a mount 162 fixed to the underside of frame 80 and the other end of the shaft retained by mount 154. The forward end of cam shaft 160 forms a flat head 164 and the sides of the head engage notches 166 and 168 in slide member 148 and lower tooth 152 respectively. A journalled roller cam follower 170 projects laterally from cam shaft 160 and engages cam 96 projecting downwardly through slot 98 of frame 80, and a coil spring 172 coaxially mounted on cam shaft biases cam follower 170 against cam 96.

Hooking mechanism 16, shown in FIGS. 10 to 14 of the drawings, comprises an angled frame 180 fixed on the front of a circular mounting disc 182 which is adjustably held by a clamping yoke 184 mounted on a collar or ring 185 slidable on spindle 86 which is fixed to frame 20 (see FIG. 1). A flange **184*a* integral with ring 185 extends perpendicularly from the axis of spindle and has a longitudinal slot 184*b* which receives a bolt 184*c* releasably attaching yoke 184 to the ring for slidable adjustment. Yoke 84 is mounted on a gooseneck bracket 184*d* because yoke 184 must have a longer stroke of adjustment along spindle 86. An hydraulic cylinder and piston assembly 188, fed by lines 189, is fixed on the rear side of mounting disc 182 with reciprocable piston rod 190 projecting rearwardly. A stroke adjusting locking nut 192 is threaded onto piston rod 190 whereby on reciprocation of the piston rod the locking nut abuts an annular boss 191. Piston rod 190 also has a portion 194 projecting forwardly through mounting disc 182 on which is fixed a pusher cam 196 with a vertically oriented concave cam surface 197. Cam 196 slides in a slot 198 in frame 180 guided by a slide retainer 199. A bending lever 200 lies adjacent cam 196 and has a crank arm 202 which is pivotally connected with frame 180 by a pivot pin 204 held on the frame by a cap 206. Bending lever 200 and crank arm 202 are spaced apart by a journalled roller cam follower 208. One end of bending lever 200 carries a laterally projecting journalled roller 210 which travels in a channel iron 211 fixed to frame 180. The other end of lever 200 carries a laterally projecting circumferentially grooved journalled bending roller 212. A tension spring 214 interconnects a post 216 on lever 200 and a hook 218 fixed to cam 196**.

A split mounting head 220 is fixed to the front end of frame 180 and carries a laterally projecting replacable arbor 222 held in the head by a bolt 224. A removable guide plate 226 is bolted to the front edge of head 220. Below arbor 222, head 220 has an aperature 228 with a bevelled edge to seat a pusher plate 230 which is mounted on one arm 232 of a bell crank lever 234 projecting into the aperture. Bell crank 234 is pivotally mounted on a pin 236 which is fixed in a block 238 secured to frame 180. The other arm 240 of bell crank 234 projects through a slot 242 (see FIG. 11) in frame 180 and rests behind cam 196. A plunger 244 slidably seated in a retainer block 246 is urged against frame 180 by a compression spring 248 to seat pusher plate 230 in aperture 228 of head 220.

Wire cutter 18 indicated generally by arrow 2 in FIG. 1 and shown more particularly, shown in FIGS. 15, 15*a* and 15*b* of the drawings, comprises a head frame 250 carried by a shaft 252 which is held by clamp 254 which also engages a slide bar 256 mounted on spindle 86 parallel to the axis of the spindle. Head 250 supports a hydraulic cylinder and piston unit 258 having a reciprocable piston rod 260 extending downwardly with the free end of the piston carrying a cutter guide 262 slidable in grooves within the head. A cutter blade 264 is removable attached to guide 262 by a bolt 266. A square shear die 268 is located below die guide 262 within head 250, resting on a base 270 of the head and held in position by a pair of set screws 272. A pad 274 is located below cutter 264 and beside die 268, the pad being mounted on a post 276 slidable in base 270 of head 250 and urged upwardly by a compression spring 278 coaxial with the post. Head 250 is held in shaft 252 by a tongued guide 280 which slides in a grooved cross-member 282 on the shaft. An arcuate slot 284 in guide 280 receives a bolt 286 threaded into cross-member 282. Hydraulic unit 258 is supplied through line 288 connected to a manifold 290 mounted on spindle 86, which is in turn supplied through lines 292 from an hydraulic source 294 (see (FIG. 1) which also supplies hydraulic unit 88 of coil bending mechanism 16.

As seen in FIG. 15, spindle 86 is slidably mounted concentrically on a shaft 296 fixed at each end to frame 20. An arm 298 extends radially from one end of spindle 86 and carries a tubular boss 300 which is slidable along a guide bar 302 fixed to frame 20 parallel to shaft 296. A hydraulic cylinder and piston unit 304 is mounted on frame 20 with a piston rod 306 parallel to shaft 296, the unit being connected by lines 308 to hydraulic source 294. Piston rod 306 connects with arm 298 through a telescopic release unit 309 comprising a cylinder 310 and a lock nut 312 (shown loosened) engaging threads 314 on a rod 316 having a head 318 movable within the cylinder.

In the operation of the described apparatus, carrier 12 is loaded by an operator with spring blanks 320, as indicated by arrow 322 at station I in FIG. 2, by inserting a blank between each pair of open jaws 28, 32 as Geneva cam 78 brings each succeeding pair of jaws into a loading position on the manual operation of treadle 70. Blank 320 is placed on fixed jaw 28 and the operation of treadle 70 actuates lever 64 to close movable jaw 32 whereby blade 56 is wedged between two adjacent coils of the spring blank. The closing of movable jaw 32 is effected by the rotation of lever 64 in a clockwise direction as seen in FIG. 2 whereby eccentric 42 and wear ring 43, located in notch 40, move against flange 34. As seen in FIG. 3, blade holder 54 of movable jaw 32 is adjustable by nuts 52 to accommodate blanks of different diameters such as spring blank 320A of smaller diameter.

When disc 22 is advanced by Geneva cam 78 to bring the next pair of jaws 28 and 32 into loading position, clamped spring blank 320 is moved to station II into a position between the pair of opposed bending mechanisms 14, one located on each side of carrier 12. To set up bending mechanism 14 before the automatic bending operation is begun, a rough positioning is first obtained by locating spindle 86 in its advanced position (to the left as seen in FIGS. 1 and 15) with hydraulic unit 304 fully extended. Telescopic unit 309 is then released by unlocking nut 312 which allows manual adjustment of the bending mechanism to the extent of the length of stroke of head 318 in chamber 310 of the telescopic unit. When bending unit 14 has been roughly positioned, nut 312 is relocked on cylinder 310. An exact positioning of bending mechanism 14, in relation to the wire size and diameter of a specific spring blank 320 to be hooked, as seen in FIG. 7, is then achieved by: (1) adjusting the position of yoke 84 on spindle 86 by means of slidable ring 85 to align upper tooth 150 between the first two coils at the end of the spring blank, and also rotationally adjusting disc 82 on yoke 84; (2) adjusting mandrel and anvil unit 136 along slot 140 to insert mandrel 138 into the end of the blank with the end of anvil 137 abutting the end of the blank and the free end of the end coil (in the case where the end coil is to be bent to form a hook) lying in recess 139 of anvil 137; and (3) adjusting the position of tooth 114 to lie adjacent the blank between the first two coils at the end of the blank, by means of nut 127 which allows shaft 122 of cam 118 to be moved in slot 124 of frame 80 and also allows the shaft to be rotated to change the angle of the cam (for varying the degree of overbend). Also, locking nut 92 is used to adjust the stroke of hydraulic unit 88 and therefore the length of the pullout by tooth 114.

Figure 6A:
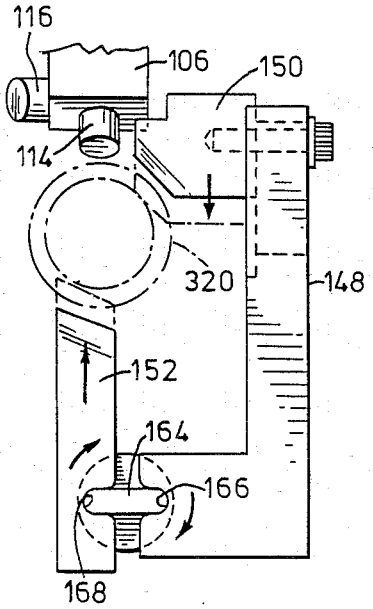

In the operation of bending mechanism 14, as shown in FIGS. 8 and 9, the bending mechanisms are advanced with spindle 86 by actuating unit 304 to have mandrels 138 of the bending mechanisms engage the opposite ends of the coil blank, as seen in FIG. 7, to centre the coil blank. In this position of each bending mechanism 14, piston rod 90 of hydraulic unit 88 is fully advanced (to the right as seen in FIG. 7) with locking nut 92 spaced from disc 82 and tooth 114 positioned above the end portion of spring blank 320. Piston rod 90 of hydraulic unit 88 is then retracted (moved to the left in the direction of arrow 321 as seen in FIG. 8) which actuates cam followers 110 and 170. Bending lever 106 is moved rearwardly and, at the same time, block 94 moves cam 96 rearwardly to engage cam follower 170 which causes cam shaft 160 to rotate and move upper tooth 150 downwardly and lower tooth 152 upwardly between the first two coils at the end of spring blank 320, as seen in FIG. 6*a*. At the same time, acting against spring 131, cam follower 110 travels along cam 118 to force tooth 114 downwardly between the first two coils at the end of spring blank 320. As piston rod 90 is fully retracted, as seen in FIG. 9, the end loop 322 of spring blank 320 is bent downwardly over mandrel unit 136, into a position transverse to the coils of spring blank 320, to form a hook.

Where it is desired to bend the laterally extending free leg end 324 of coil spring blank 320 to form a hook, bending lever 106 performs the action shown in FIGS. 7*a*, 7*b* and 7*c*, using peg 116, to bend leg 324 into a position transverse to the coils of spring blank 320. As piston rod 90 moves bending lever 106 forwardly, leg 324 of the spring blank is deflected by the bevelled end of peg 116 and slips into a groove in the peg as seen in FIGS. 7*a* and 7*b*. Thereafter as piston rod 90 is retracted bending lever 106 and peg 116 move leg 324 downwardly over mandrel unit 136 as seen in FIG. 7*c*. Each coil bender 14 is then retracted on spindle 86 by hydraulic unit 304.

When both legs 324 of spring blank 320 are bent in the general direction of the axial plane of the blank in the manner shown in FIG. 7*c*, it is then necessary to form each leg 324 into a hook. To achieve this, the next actuation of Geneva cam 78 and carrier 12 advances the blank to station III between opposed wire hooking mechanisms 16. To set up hooking mechanism 16 before the automatic hooking operation is begun, a rough positioning is first obtained through the adjustment of spindle 86 as previously described with respect to bending mechanism 14. An exact positioning of hooking mechanism 16 is then achieved by: (1) adjusting the position of yoke 184 on spindle 86 by means of slidable ring 185 to align arbor 222 with leg 324, and also rotationally adjusting disc 185 on yoke 184; and (2) adjusting the stroke of piston rod 190 by locking nut 192. The hooking mechanisms are advanced with spindle 86 by actuating hydraulic unit 304 to position free end 324 of the spring blank between arbor 222 and grooved roller 212 as seen in FIG. 11 of the drawings. Hydraulic unit 188 is then actuated to move piston rod 190 (and its forward portion 194) forwardly (to the right as indicated by arrow 326 in FIG. 12). This causes cam follower 208 to travel downwardly along cam surface 197 of pusher cam 196 as pivot pin 204 rotates, which in turn causes bending lever 200 to move downwardly and grooved roller 212 to move laterally into contact with leg 324 of coil spring blank 320 to force the leg against arbor 222. Continuing its lateral travel, roller 212 then swings arcuately around arbor 222 as seen in FIG. 12, bending leg 324 around the mandrel to form a hook 328. During the movement of bending lever 200, tension spring 214 keeps cam follower 208 in contact with cam 196 and roller 210 travels along channel iron 211 to maintain the desired orientation of the bending lever. The degree of overbend of hook 328 is governed by the adjustment of locking nut 192 on piston rod 190. It should be noted that the axis of cam follower 208 does not move below the projected axis of piston rod 190.

On the return stroke of piston rod 190, pusher cam 196 comes into contact with arm 240 of bell crank 234, causing the bell crank to pivot about pin 236 against the action of spring 248 and moving pusher plate 230 outwardly from head 220 to move hook 328 laterally off mandrel 222 as seen in FIG. 14 of the drawings. Each hooking mechanism 16 is then retracted on spindle 86 by hydraulic unit 304.

In the final operation step, carrier 12 advances coil spring blank 320 to station IV between opposed wire cutters 18 when the operator again depresses treadle 70 to load the carrier. For the wire cutting operation each wire cutter 18 is adjustable in three mutually perpendicular directions and may be exactly located by: (1) adjusting clamp 254 on slide bar 256 as indicated by arrow 330 in FIG. 15; (2) adjusting guide 280 on shaft 252 as indicated by arrow 332; and (3) adjusting shaft 252 on clamp 254 as indicated by arrow 334. In operation, wire cutters 18 are advanced by hydraulic units 304 to meet hooks 328 of coil spring blank 320 whereby each hook lies on die 268 of the corresponding wire cutter, as seen in FIGS. 15*a* and 15*b* of the drawings. Hydraulic unit 258 is then actuated to move cutter 264 against the hook 328 to shear the free end portion of the hook to the desired length. After hook 328 has been sheared, hydraulic unit 304 is actuated to move wire cutter 18 away from coil blank 320 and from carrier 12.

It will be appreciated that the reciprocal movement of spindle 86, actuated by hydraulic unit 304, acts to move bender 14, hooker 16 and wire cutter 18 simultaneously since all three mechanisms are mounted on the spindle.

The next intermittent rotation of carrier 12, actuated by treadle 70 as the operator continues to load the carrier, advances spring 320 to station V which brings arm 58 of toggle 46 into contact with peg 76, as seen in FIG. 2, causing the toggle and eccentric 42 to be rotated to release jaw 32 and allowing the hooked spring to drop from clamping mechanism 26 into a collecting bin (not shown).

It will be appreciated that the apparatus of the present invention allows different types of hooks to be formed on a coil spring blank in one operation. Either end of the blank may be formed into a pullout hook or an extended hook (i.e. a hook with an extended leg as shown in FIG. 15*b* of the drawings), both ends of the blank may be hooked in the same operation while each end of the blank may be formed into a different type of hook, and the hooks may be different axial planes of the coil. In the case of a pullout hook a preliminary rotational orientation of the coil blank is not necessary to obtain a specific gap between the end of the hook and the coil because the end of the hook can be trimmed after the hook is formed.

A wide range of coil blanks varying in wire diameter and coil diameter may be accommodated by the device of the invention. In the initial clamping operation clamping mechanism 26 of carrier 12 is adjustable as seen in FIG. 3 of the drawings. Subsequently the same adjustability is seen in the clamping mechanism shown in FIG. 6*a*. In each instance the tooth (or teeth) is replacable. Also, mandrel and anvil unit 136 as well as saddle 144 are replacable to accomodate coil blanks of different wire and coil diameters and also to obtain different degrees of overbending on anvil 137. It should also be noted again that pivot bolt 129 of bracket 126 is aligned with pivot bolt 108 of bending lever 106 at the forward position of the bending lever (see FIG. 6) in order that the slope of cam 118 may be adjusted without altering the initial movement of the bending lever, thus allowing the adjustment of the bending lever with respect to the end coil of coil blank 320.

In the formation of an extended hook any configuration of the hook itself may be selected by changing arbor 222 on hooking mechanism 16 and adjusting the length of the path to be followed by bending roller 212 (by adjusting locking nut 192). The length of the leg of the hook may be chosen by adjusting the position of hooking mechanism 16 on spindle 86.

I claim:

1. Apparatus for forming at least one laterally extending leg of a coil spring blank into a hook, comprising:

movable carriage means for advancement through a succession of stations, including releasable means to clamp the spring blank at the first of said stations;

bending means at the second of said stations to bend the leg of the spring blank into a position transverse to the coils of the blank;

hooking means at the third of said stations to bend the leg to form a hook; and cutting means at the fourth of said stations to sever the free end of the hook to a predetermined length.

2. Apparatus for forming at least one end of a coil spring blank into a hook, comprising:

movable carriage means for advancement through a succession of stations, including releasable means to clamp the spring blank at the first of said stations;

bending means at the second of said stations to bend one end loop of the spring blank into a position transverse to the coils of the blank to form a hook; and cutting means at a further succeeding one of said stations to sever the free end of the hook to a predetermined length.

3. Apparatus as claimed in claim 1 in which the carriage means is positioned between (1) a pair of said bending means, (2) a pair of said hooking means, and (3) a pair of said cutting means, whereby both legs of the spring blank are formed into hooks.

4. Apparatus as claimed in claim 2 in which the carriage means is positioned between (1) a pair of said bending means, and (2) a pair of said hooking means, whereby both end coils of the spring blank are formed into hooks.

5. Apparatus as claimed in claim 1 or claim 2 in which the carriage is rotational and carries said clamping means at each of said stations spaced circularly thereon, at least that end of the coil spring blank to be formed into a hook extending laterally from the carriage.

6. Apparatus as claimed in claim 1 or claim 2 in which the carriage is rotational and carries said clamping means at each of said stations spaced circularly thereon, at least that end of the coil spring blank to be formed into a hook extending laterally from the carriage, the clamping means comprising a fixed jaw and a movable jaw spaced from the fixed jaw, the movable jaw carrying a blade wedgable between two adjacent coils of the spring blank, and means actuable to move the movable jaw towards and away from the fixed jaw.

7. Apparatus as claimed in claim 1 or claim 2 in which the carriage is rotational and carries said clamping means at each of said stations spaced circularly thereon, at least that end of the coil spring blank to be formed into a hook extending laterally from the carriage, the clamping means comprising a fixed jaw and a movable jaw spaced from the fixed jaw, the movable jaw carrying a blade wedgable between two adjacent coils of the spring blank, and means actuable to move the movable jaw towards and away from the fixed jaw, the actuable means comprising a toggle fixed to an eccentric rotatable to bear against the movable jaw which is spring biased away from the fixed jaw, the toggle being positioned laterally of the carriage, means operable to actuate the toggle to close the jaws, and means engagable with the toggle on movement of the carriage into a predetermined position to open the jaws.

8. Apparatus as claimed in claim 1 in which the bending means comprises;

a unit having a frame, reciprocable drive means mounted on the frame, a lever pivotally mounted on the drive means and aligned in the direction of reciprocation thereof, means to clamp the blank at the second station adjacent the leg on movement of the drive means in one direction, means on the lever (1) to engage the leg and to bend the leg into said transverse position on movement of the drive means in said one direction and (2) to disengage from the leg on movement of the drive means in the opposite direction; and means to move the unit into position to act on the blank.

9. Apparatus as claimed in claim 2 in which the bending means comprises:

a unit having a frame, reciprocable drive means mounted on the frame, a lever pivotally mounted on the drive means and aligned in the direction of reciprocation thereof, means to clamp the blank at the first station adjacent the end lop of the coil blank on movement of the drive means in one direction, and means on the lever (1) to engage the end loop and to bend the end loop into said transverse position on movement of the drive means in said one direction and (2) to disengage from the end loop on movement of the drive means in the opposite direction; and means to move the unit into position to act on the blank.

10. Apparatus as claimed in claim 8 or claim 9 in which the means to clamp the blank comprises a pair of opposed wedges insertable between two coils of the spring blank, means including cam means actuable on movement of the drive means in said one direction to move the wedges towards one another and on movement of the drive means in the opposite direction to move the wedges away from one another.

11. Apparatus as claimed in claim 1 in which the hooking means comprises:

a unit having a frame, reciprocable drive means mounted on the frame, a lever pivotally mounted on the frame and aligned in the direction of reciprocation thereof, the lever having a roller projecting laterally therefrom, a mandrel mounted on the frame parallel to the roller, and cam means actuable by movement of the drive means in one direction to move the roller in an arcuate path about the mandrel; and means to move the unit into position to act on the blank.

12. Apparatus as claimed in claim 11 in which the cam means comprises a cam mounted on the drive means, and a cam follower mounted on the lever and pivotable eccentrically on the frame.

13. Apparatus as claimed in claim 11 including lever means actuable on movement of the drive means in the opposite direction to move the hooked leg laterally off the mandrel.

14. Apparatus as claimed in claim 1 in which the cutting means comprises a frame, reciprocable drive means mounted on the frame, a die block mounted on the frame, a cutter blade mounted on the drive means in shearing relationship with the die block, and means to adjust the position of the frame (1) rotationally in the shearing plane (2) rotationally in the plane of the die blocking surface, and (3) linearly transverse to the shearing plane.

15. Apparatus as claimed in claim 14 in which the means to adjust the position of the frame comprises a spindle, a bar mounted on the spindle parallel to the axis thereof, transverse clamping means mounted on the bar and adjustable longitudinally thereon, a rotationally adjustable shaft mounted on the clamping means parallel to the axis of the spindle, the frame being mounted on the shaft by means to adjust the frame rotationally in a plane parallel to the shaft axis.

16. Apparatus as claimed in claim 1 or claim 2 including means at the final one of said stations to release the hooked spring from the clamping means.

17. Apparatus as claimed in claim 8 or claim 11 in which the means to move the unit into position comprises a spindle axially parallel to the direction of reciprocation of the drive means, a slidably adjustable collar mounted on the spindle and having the unit mounted thereon, and means to move the spindle reciprocally on its axis.

18. Apparatus as claimed in claim 17 in which the means to move the spindle comprises an hydraulic cylinder and piston assembly, the spindle having a bar projecting laterally therefrom, the rod of the piston of the hydraulic assembly being positioned parallel to the axis of the spindle, and means to telescope the piston rod.

19. Apparatus as claimed in claim 18 in which the means to telescope the piston rod comprises a cylinder on the end of the piston rod, a further rod threaded and having a bend at one end within the cylinder and slidable therein, the other end of the further rod being fixed to the bar, and a lock nut on the further rod engageable on the threads thereof to abut the cylinder.

20. In apparatus for forming at least one laterally extending leg of a coil spring blank into a hook, bending means comprising:

a frame;

reciprocable drive means mounted on the frame;

a lever pivotally mounted on the drive means and aligned in the direction of reciprocation thereof;

means to clamp the blank adjacent the leg on movement of the drive means in one direction; and means on the lever (1) to engage the leg and to bend the leg into a position transverse to the coils of the blank on movement of the drive means in one direction and (2) to disengage from the leg on movement of the drive means in the opposite direction.

21. In apparatus for forming at least one end of a coil spring blank into a hook, bending means comprising:

a frame;

reciprocable drive means mounted on the frame;

a lever pivotally mounted on the drive means and aligned in the direction of reciprocation thereof;

means to clamp the blank adjacent one end loop of the coil on movement of the drive means in one direction; and means on the lever (1) to engage the end loop of the coil and to bend the end loop into a position transverse to the coils of the blank on movement of the drive means in one direction and (2) to disengage from the end loop on movement of the drive means in the opposite direction.

22. In apparatus for forming at least one laterally extending leg of a coil spring blank into a hook, wherein the leg projects transversely from the coils of the blank, hooking means comprising:

a frame;

reciprocable drive means mounted on the frame;

a lever pivotally mounted on the frame and aligned in the direction of reciprocation of the drive means, the lever having a roller projecting laterally therefrom;

a mandrel mounted on the frame parallel to the roller; and cam means actuable by movement of the drive means in one direction to move the roller in an arcuate path about the mandrel.

23. Apparatus as claimed in claim 22 including lever means actuable on movement of the drive means in the opposite direction to move the hooked leg laterally off the mandrel.

24. Apparatus as claimed in claim 13 or claim 23 in which the lever means comprises a bell crank pivotably mounted on the frame and having one arm movable parallel to the mandrel and the other arm movable by the drive means.

25. Apparatus as claimed in claim 8 or claim 20 including an anvil mounted on the frame and having a mandrel projecting therefrom receivable into the coil when the unit is moved into position to act on the blank, the anvil being positioned to support the leg when fully bent into said transverse position.

26. Apparatus as claimed in claim 25 or claim 21 including an anvil mounted on the frame and having a mandrel projecting therefrom receivable into the coil when the unit is moved into position to act on the blank, the anvil being positioned to support the end loop when fully bent into said transverse position.

27. Apparatus as claimed in claim 8 or claim 20 in which a cam is adjustably mounted on the frame and a cam follower is mounted on the lever for interaction with the cam on movement of the drive means.

28. Apparatus as claimed in claim 27 or claim 21 in which a cam is adjustably mounted on the frame and a cam follower is mounted on the lever for interaction with the cam on movement of the drive means.

29. Apparatus as claimed in claim 8 or claim 20 in which the means on the lever to engage and bend the leg comprises a peg projecting laterally from the lever, one side of the peg being bevelled and the other side being recessed.

30. Apparatus as claimed in claim 29 or claim 21 in which the means on the lever to engage and bend the end loop comprises a tapered tooth.

31. A method of forming at least one laterally extending leg of a coil spring blank into a hook, comprising the steps, in sequence, of:

releasably clamping, at a first station, the spring blank, on movable carriage means movable through succeeding stations;

moving the carriage means to advance the spring to a second station and bending the leg of the spring blank into a position transverse to the coils of the spring blank;

moving the carriage means to advance the spring blank to a third station and bending the leg to form a hook; and moving the carriage means to advance the spring blank to a fourth statiton and severing the free end of the hook to a predetermined length.

32. A method of forming at least one end of a coil spring blank into a hook, comprising the steps, in sequence, of:

releasably clamping, at a first station, the spring blank on movable carriage means movable through succeeding stations;

moving the carriage means to advance the spring blank to a second station and bending one end loop of the spring blank into a position transverse to the axis of the coils of the spring blank to form a hook; and moving the carriage means to advance the spring blank to a further succeeding station and severing the free end of the hook to a predetermined length.

33. A method as claimed in claim 31 or claim 32 in which the spring blank is further clamped at the second station by inserting a pair of opposed teeth between two coils of the spring blank.

34. A meethod as claimed in claim 31 or claim 32 including the step of releasing the hooked spring from the carriage means at a final station.

* * * * *